US007759293B2

(12) United States Patent
Shirahama et al.

(10) Patent No.: US 7,759,293 B2
(45) Date of Patent: Jul. 20, 2010

(54) HYDRAULIC OIL COMPOSITION FOR SHOCK ABSORBERS

(75) Inventors: Shinichi Shirahama, Yokohama (JP); Toru Aoki, Yokohama (JP); Naozumi Arimoto, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 886 days.

(21) Appl. No.: 11/282,191

(22) Filed: Nov. 18, 2005

(65) Prior Publication Data

US 2006/0111255 A1 May 25, 2006

(30) Foreign Application Priority Data

Nov. 22, 2004 (JP) ..... 2004-337618
Nov. 22, 2004 (JP) ..... 2004-337619

(51) Int. Cl.
*C10M 169/04* (2006.01)
*C10M 145/14* (2006.01)

(52) U.S. Cl. ..... 508/208; 508/469

(58) Field of Classification Search ..... 508/208, 508/469

See application file for complete search history.

(56) References Cited

U.S. PATENT DOCUMENTS

| | | | | | |
|---|---|---|---|---|---|
| 2,990,373 | A | | 6/1961 | Ragborg | |
| 3,235,498 | A | * | 2/1966 | Waldmann | 508/214 |
| 4,549,004 | A | * | 10/1985 | von Au et al. | 528/42 |
| 4,776,967 | A | * | 10/1988 | Ichihashi et al. | 508/185 |
| 5,130,041 | A | * | 7/1992 | Groenhof | 252/78.3 |
| 5,137,980 | A | * | 8/1992 | DeGonia et al. | 525/327.6 |
| 5,374,363 | A | * | 12/1994 | Fukuda et al. | 508/152 |
| 5,766,513 | A | * | 6/1998 | Pillon et al. | 516/123 |

FOREIGN PATENT DOCUMENTS

| | | | |
|---|---|---|---|
| CA | 1100930 | A1 | 5/1981 |
| DE | 3207654 | | 10/1982 |
| EP | 0992570 | A3 | 8/2000 |
| GB | 752741 | | 7/1956 |
| JP | 05-255683 | A | 10/1993 |
| JP | 06-128581 | A | 5/1994 |
| JP | 07-224293 | A | 8/1995 |
| JP | 07-258678 | A | 10/1995 |
| JP | 2000-192067 | A | 7/2000 |
| JP | 2002-053886 | A | 2/2002 |
| JP | 2002-194376 | A | 7/2002 |
| JP | 2004-035624 | A | 2/2004 |
| WO | 9314180 | A1 | 7/1993 |

* cited by examiner

*Primary Examiner*—Walter D Griffin
*Assistant Examiner*—Frank C Campanell
(74) *Attorney, Agent, or Firm*—Panitch Schwarze Belisario & Nadel LLP

(57) ABSTRACT

Hydraulic oil compositions for shock absorbers comprises a lubricating base oil and at least one type of silicone oil selected from the group consisting of silicone oils with a kinematic viscosity at 25° C. of 10,000 to 350,000 $mm^2/s$ and fluorine-modified silicone oils with a kinematic viscosity at 25° C. of less than 10,000 $mm^2/s$. The compositions may further comprise a viscosity index improver. The compositions can enhance the damping force and initial damping properties of a shock absorber and thus improve the ride comfort of an automobile equipped with such a shock absorber.

4 Claims, No Drawings

HYDRAULIC OIL COMPOSITION FOR SHOCK ABSORBERS

BACKGROUND OF THE INVENTION

The present invention relates to hydraulic oil compositions for shock absorbers.

There are various types of shock absorbers, but they basically comprise a piston with a valve attached thereto and an outer cylinder. The piston is fixed to a rod and slides up and down along the inner surface of the cylinder while the rod slides along the seal portion of a rod guide means. A shock absorber is usually filled with a hydraulic oil and if necessary gas and dampens shocks by the resistance of the oil to the valve movement.

Since in operation a hydraulic oil for shock absorber is always in an oscillation state and mixed with air or gas, the oil is likely to create air bubbles or foams. Rapid movement of the piston creates reduced pressure which also causes bubbling or foaming. Furthermore, the hydraulic oil for shock absorber is exposed to the outdoor air and the temperature of the oil also change from lower temperatures to elevated temperatures due to the change of the outdoor air temperature. As a result of such temperature change, the oil changes in viscosity, resulting in changes in the damping force of the shock absorber. In order to suppress the viscosity change as much as possible, a viscosity index improver has been used. However, it is known that addition of such a viscosity index improver is likely to create bubbles. Therefore, the hydraulic oil for shock absorbers is always exposed to situations under which bubbles are likely to be formed. When the valve moves through such bubbles, it meets little resistance and thus fails to generate any damping force. Therefore, the shock absorber can not absorb oscillation caused by road impacts or shocks or the like sufficiently and adversely affect the ride comfort of an automobile.

Conventionally, a shock absorber has been improved in friction characteristics, anti-wear properties or durability by optimizing a friction modifier or an anti-wear agent for a hydraulic oil for a shock absorber (for example, as disclosed in Japanese Patent Laid-Open Publication Nos. 7-224293, 7-258678, 6-128581, 2000-192067, 2002-194376 and 5-255683). Recently, it is reported that the ride comfort of an automobile is improved by enhancing the frictional force of a shock absorber (Japanese Patent Laid-Open Publication No. 2004-035624). In general, the compositions disclosed in the above-mentioned publications contain a polymethacrylate-based viscosity index improver. Alternatively, Japanese Patent Laid-Open Publication No. 2002-053886 discloses a hydraulic oil composition for shock absorbers containing an ethylene-propylene copolymer or a styrene-maleic acid ester copolymer in an amount of 1 to 15 percent by mass based on the mass of the resin, which copolymer is excellent in anti-cavitation properties and can provide a shock absorber with long-lasting damping force.

However, it is now found that mere selection of a proper friction modifier, anti-wear agent or viscosity index improver is insufficient to enhance the damping force of a shock absorber and improve a capability thereof to suppress an automobile from oscillating when it travels over obstacles such as bumpy road surfaces and absorb the oscillation or impacts caused thereby instantaneously (hereinafter referred to as "initial damping properties") and thus the ride comfort of an automobile.

BREIF SUMMARY OF THE INVENTION

An object of the present invention is to provide a hydraulic oil composition for shock absorbers which composition is capable of enhancing and improving the damping force initial dumping properties of a shock absorber so as to improve the ride comfort of an automobile equipped with such a shock absorber.

It was found by the inventors of the present invention that there was a limit to improve the initial damping properties using a dimethylpolysiloxane with a kinematic viscosity at 25° C. of less than 10,000 $mm^2/s$. It was also found that the use of a composition comprising a lubricating base oil and a silicone oil with a kinematic viscosity within a certain range or a fluorine-modified silicone oil even with a kinematic viscosity at 25° C. of less than 10,000 $mm^2/s$ was effective in achieving the above-mentioned object and particularly the use of such a fluorine-modified silicone oil is effective in improving significantly the initial damping properties of a shock absorber. Furthermore, it was found that a composition comprising a lubricating base oil and a combination of such a specific silicone oil with a specific viscosity index improver was capable of enhancing the damping force of a shock absorber and providing therefor more excellent initial damping properties and thus improved ride comfort.

That is, the present invention relates to a hydraulic oil composition for shock absorbers comprising a lubricating base oil and at least one type of silicone oil selected from the group consisting of silicone oils with a kinematic viscosity at 25° C. of 10,000 to 350,000 $mm^2/s$ and fluorine-modified silicone oils even with a kinematic viscosity at 25° C. of less than 10,000 $mm^2/s$.

Preferably, the hydraulic oil composition of the present invention further comprises a viscosity index improver.

Preferably, the viscosity index improver is an olefin (co) polymer-based viscosity index improver and/or a polymethacrylate-based viscosity index improver.

Preferably, the viscosity index improver is an olefin (co) polymer-based viscosity index improver or a mixture of an olefin (co)polymer-based viscosity index improver and a polymethacrylate-based viscosity index improver.

Preferably, the olefin (co)polymer-based viscosity index improver is an ethylene-propylene copolymer-based viscosity index improver.

Preferably, the olefin (co)polymer-based viscosity index improver is a polybutene-based viscosity index improver.

preferably, the content of the olefin (co)polymer-based viscosity index improver is from 0.01 to less than 1 percent by mass in terms of polymer based on the total mass of the composition.

The present invention also relates to a method for improving the damping force of a shock absorber and the initial damping properties and thus ride comfort of a vehicle equipped therewith wherein a hydraulic oil composition used for the shock absorber comprises a lubricating base oil and at least one type of silicone oil selected from the group consisting of silicone oils with a kinematic viscosity at 25° C. of 10,000 to 350,000 $mm^2/s$ and fluorine-modified silicone oils even with a kinematic viscosity at 25° C. of less than 10,000 $mm^2/s$.

The present invention also relates to a method for improving the damping force of a shock absorber and the initial damping properties and thus ride comfort of a vehicle equipped therewith wherein the hydraulic oil composition used for shock absorbers further comprises a viscosity index improver.

The present invention will be described below in more detail.

There is no particular restriction on lubricating base oils which may be used in the hydraulic oil composition of the present invention. Any of mineral or synthetic base oils which are used in an ordinary lubricating oil may be used in the present invention.

Specific examples of such mineral base oils include those which can be obtained by subjecting a lubricating oil fraction produced by vacuum-distilling a topped crude resulting from atmospheric distillation of a crude oil, to any one or more treatments selected from solvent deasphalting, solvent extraction, hydrocracking, solvent dewaxing, and hydrorefining; wax-isomerized mineral oils; and those obtained by a technique to isomerizes GTL WAX (Gas to Liquid Wax).

Specific examples of such synthetic base oil include polybutenes and hydrides thereof; poly-α-olefins such as 1-octene oligomer and 1-decene oligomer, and hydrides thereof; diesters such as ditridecyl glutarate, di-2-ethylhexyl adipate, diisodecyl adipate, ditridecyl adipate, and di-2-ethylhexyl cebacate; polyolesters such as neopentyl glycol ester, trimethylolpropane caprylate, trimethylolpropane pelargonate, pentaerythritol-2-ethyl hexanoate, and pentaerythritol pelargonate; aromatic synthetic oils such as alkylnaphthalenes, alkylbenzenes, and aromatic esters; and mixtures thereof.

Any one of the above-described mineral base oils or synthetic base oils or any mixture of two or more types selected from these base oils may be used in the present invention. For example, the base oil used in the present invention may be one or more of the mineral base oils or synthetic base oils or a mixed oil of one or more of the mineral base oils and one or more of the synthetic base oils.

There is no particular restriction on the kinematic viscosity of the lubricating base oil used in the present invention. However, from the view point of adjusting the hydraulic oil composition to the damping force required for an ordinary shock absorber, the lower limit kinematic viscosity at 40° C. of the base oil is preferably 3 $mm^2/s$, more preferably 6 $mm^2/s$ while the upper limit is preferably 60 $mm^2/s$, more preferably 40 $mm^2/s$ and even more preferably 20 $mm^2/s$. With the objective of obtaining a composition with a lower friction, the upper limit is further more preferably 10 $mm^2/s$ or lower, particularly preferably 9 $mm^2/s$ or lower.

There is no particular restriction on the viscosity index of the lubricating base oil used in the present invention. However, the viscosity index of the base oil is preferably 80 or greater, more preferably 95 or greater because the basic performance required for a shock absorber, i.e., damping function depends on the viscosity of the hydraulic oil and the change of the damping force due to temperature changes should be reduced as much as possible.

Next described is the silicone oil. The silicone oil used in the present invention is at least one type of silicone oil selected from the group consisting of silicone oils with a kinematic viscosity at 25° C. of 10,000 to 350,000 $mm^2/s$ (hereinafter referred to as the "Silicone Oil(s) (A)) and fluorine-modified silicone oils even with a kinematic viscosity at 25° C. of less than 10,000 $mm^2/s$ (hereinafter referred to as the "Silicone Oil(s) (B)).

Silicone Oils (A) which may be used in the hydraulic oil composition for shock absorber of the present invention are those having a kinematic viscosity at 25° C. of 10,000 to 350,000 $mm^2/s$. However, the kinematic viscosity at 25° C. of Silicon Oils (A) is preferably from 30,000 to 200,000 $mm^2/s$, more preferably 40,000 to 150,000 $mm^2/s$, most preferably 50,000 to 100,000 $mm^2/s$. A silicone oil with a kinematic viscosity at 25° C. of less than 10,000 $mm^2/s$ other than fluorine-modified silicone oils is not preferable because it is less effective in improving the damping force of a shock absorber, while a silicone oil with a kinematic viscosity at 25° C. of greater than 350,000 $mm^2/s$ is not preferable as well because it is less effective in improving the damping force of a shock absorber and unlikely to be dispersed in a hydraulic oil. The term "kinematic viscosity of the silicone oil" used herein means the kinematic viscosity of a silicone oil per se which is not diluted with a solvent.

Examples of Silicone Oils (A) which may be used in the present invention include various types of known silicone oils with the above-described kinematic viscosity. Therefore, Silicone Oils (A) may have any structure and may be organopolysiloxanes represented by the formula, or modified products thereof:

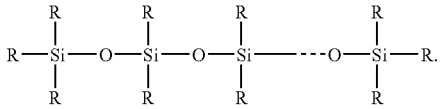

(1)

In formula (1), the groups "R" are each a hydrocarbon group having 1 to 10 carbon atoms and may be the same or different from each other. The hydrocarbon group having 1 to 10 carbon atoms may be an alkyl, alkenyl, aryl, alkylaryl or arylalkyl group each having 1 to 10 carbon atoms. The groups "R" are each preferably an alkyl group having 1 to 4 carbon atoms, more preferably a methyl or ethyl group, and particularly preferably a methyl group. Silicone Oils (A) may be those obtained by substituting in whole or in part the substituents of organopolysiloxanes represented by formula (1) above, with a hydrogen, fluorine-modified hydrocarbon groups having 1 to 10 carbon atoms, or any other substituents modified agent. An example of a preferred structure of fluorine-modified organopolysiloxane is alos described with respect to Silicone oil (B) described below.

Preferred examples of Silicone Oils (A), i.e., silicone oils with a kinematic viscosity at 25° C. of 10,000 to 350,000 $mm^2/s$ include dimethylpolysiloxanes of formula (1) wherein all R groups are methyl groups with the objective of availability or cost.

Next described is Silicone Oils (B), i.e., the fluorine-modified silicone oil with a kinematic viscosity within a certain range.

Silicone Oils (B) which may be used in the hydraulic oil composition for shock absorber of the present invention are those having a kinematic viscosity at 25° C. of less than 10,000 $mm^2/s$. However, the kinematic viscosity at 25° C. of Silicone Oils (B) is preferably from 10 to 5,000 $mm^2/s$, more preferably from 50 to 2,000 $mm^2/s$, and particularly preferably from 100 to 500 $mm^2/s$. The use of Silicone Oil (B), i.e., a silicone oil modified with fluorine and even having a kinematic viscosity at 25° C. of less than 10,000 $mm^2/s$ is advantageously effective in improving the initial damping properties of a shock absorber. The use of a fluorine-modified silicone oil having a kinematic viscosity at 25° C. of 100 $mm^2/s$ or more which is particularly preferable results in a composition which is more excellent in an improvement in the initial damping properties.

Examples of Silicone Oils (B) which may be used in the present invention include various types of known fluorine-modified silicone oils with the above-described kinematic viscosity. Therefore, Silicone Oils (B) may have any structure and may be those obtained by substituting in whole or in part the substituents of organopolysiloxanes represented by formula (1) above, with a fluoroalkyl group having 1 to 10 carbon atoms.

Preferred examples of Silicone Oils (B) include those having a structure wherein a part of the methyl groups of a dimethylpolysiloxane of formula (1) wherein the groups "R" are methyl groups is substituted by a fluorine-modified alkyl group having 1 to 10, preferably 1 to 4 carbon atoms. Specific examples of the fluorine-modified alkyl group having 1 to 10 carbon atoms include a mono-, di- or tri-fluoromethyl group, a mono-, di- or tri-fluoroethyl group, a mono-, di- or tri-fluoropropyl group and a mono-, di- or tri-fluorobutyl group. Specific example of Silicone Oils (B) include trifluoropropylmethyl polysiloxanes wherein the substituents "R" are methyl groups, a part of which is substituted by a trifluoropropyl group.

There is no particular restriction on the content of the silicone oil selected from the group consisting of Silicone Oils (A) and Silicone Oils (B) However, in the case of using any of Silicone Oils (A) the content thereof is preferably from 1 to 100 ppm by mass, more preferably from 5 to 80 ppm by mass, even more preferably from 10 to 70 ppm by mass, particularly preferably from 20 to 60 ppm by mass, and most preferably from 30 to 50 ppm by mass, based on the total mass of the hydraulic oil composition for shock absorbers. In the case of using any of Silicone Oils (B), the content thereof is preferably from 1 to 100 ppm by mass, more preferably from 2 to 30 ppm by mass, even more preferably from 3 to 20 ppm by mass, particularly preferably from 3 to 10 ppm by mass and most preferably 3 to 8 ppm by mass, based on the total mass of the hydraulic oil composition for shock absorbers. In either case, a content of less than 1 ppm by mass would be less effective in improving the damping force or initial damping properties of a shock absorber, while a content of greater than 100 ppm by mass would fail to provide advantageous effects as balanced and would be likely to cause the reduction of the damping force or initial damping properties of a shock absorber because bubbles are unlikely to disappear.

Preferably, the hydraulic oil composition for shock absorbers of the present invention further comprises a viscosity index improver so as to further improve the damping force and initial damping properties of a shock absorber thereby improving the ride comfort of an automobile equipped therewith. Examples of such a viscosity index improver include various conventional viscosity index improvers such as olefin (co) polymer-based viscosity index improvers and viscosity index improvers other than such olefin (co)polymer-based viscosity index improvers. It is preferable to use an olefin (co)polymer-based viscosity index improver because it can improve the initial damping properties even though it is contained in a small amount. It is also preferable to use a viscosity index improver other than olefin (co)polymer-based viscosity index improvers, such as polymethacrylate-based viscosity index improvers because it can improve the initial damping properties of a shock absorber and the viscosity-temperature characteristics of the resulting hydraulic oil composition. It is, therefore, particularly preferable to use an olefin (co)polymer-based viscosity index improvers and a polymethacrylate-based viscosity index improver in combination.

Specific examples of olefin (co)polymer-based viscosity index improver which may be used in the present invention include polybutenes (polyisobutylenes) and hydrides thereof, and ethylene-α-olefin copolymers whose α-olefin may be propylene, 1-butene or 1-pentene, and hydrides thereof. Polybutene-based viscosity index improvers are effective in enhancing the damping force and initial damping properties of a shock absorber. Ethylene-α-olefin copolymers are effective not only in enhancing the damping force and initial damping properties but also capable of providing long-lasting damping force and initial damping properties.

The olefin (co)polymer-based viscosity index improver used in the present invention is necessarily large in weight-average molecular weight. The weight-average molecular weight of polybutene-based viscosity index improvers is usually from 100,000 to 1,000,000, preferably from 150,000 to 600,000, even more preferably from 250,000 to 550,000, and further even more preferably from 450,000 to 550,000. Particularly preferably, the weight-average molecular weight of polybutene-based viscosity index improvers is from 250,000 to 350,000 with the objectives of providing a shock absorber with long-lasting improved initial damping properties. The weight-average molecular weight of ethylene-α-olefin copolymers is usually from 100,000 to 1,000,000, preferably from 150,000 to 600,000, more preferably from 250,000 to 550,000 and particularly preferably from 250,000 to 350,000. An olefin (co)polymer-based viscosity index improver with a weight-average molecular weight of less than 100,000 is less effective in improving the damping force, while that with a weight-average molecular weight of greater than 1,000,000 is reduced in molecular weight by shear generated during the use of the hydraulic oil composition and thus aversely affects the ride comfort of an automobile.

In the present invention, the content of the olefin (co) polymer-based viscosity index improvers in terms of polymer (active constituent), for example, of a polybutene-based viscosity index improver is preferably from 0.005 to 5 percent by mass, more preferably from 0.01 to less than 1 percent by mass, and particularly preferably from 0.01 to 0.1 percent by mass, based on the total mass of the hydraulic oil composition. In the case of an ethylene-α-olefin copolymer, the content thereof is preferably from 0.005 to 5 percent by mass, more preferably from 0.01 to less than 1 percent by mass, and particularly preferably from 0.05 to 0.5 percent by mass. Inclusion of these olefin (co)polymer-based viscosity index improvers in such an extremely small amount in terms of polymer results in a hydraulic composition which can provide a shock absorber with excellent damping force and retentivity thereof. Therefore, the ride comfort of an automobile equipped with such a shock absorber is unlikely to change.

Some of olefin (co)polymer-based viscosity index improvers are available in the form of those containing 10 to 95 percent by mass of a diluent for the purposes of improving the solubility thereof in a base oil and handling. Such viscosity index improvers are preferably blended in such an amount that the polymer as an active constituent is contained in the above-described range.

If necessary, the hydraulic oil composition for shock absorber of the present invention may further comprise any of additives which are generally used in lubricating oils for the purpose of further improving the performance characteristics of the composition or for any purpose. Examples of such additives include various additives such as viscosity index improvers other than the above-described olefin (co)polymer-based viscosity index improvers, fiction modifiers, anti-wear agents, ashless dispersants, anti-oxidants, fluidity improvers, metal deactivators, metallic detergents, anti-corrosion agents, rust inhibitors, demulsifiers, antifoamers, and dyes.

Eligible viscosity index improvers other than the olefin (co)polymer-based viscosity index improvers include various known viscosity index improvers such as polymethacrylate-, styrene-diene copolymer-, styrene-maleic anhydride ester copolymer-and polyalkylstyrene-based viscosity index improvers. These viscosity index improvers may be contained so as to improve the viscosity-temperature properties of the hydraulic oil composition of the present invention.

There is no particular restriction on the weight-average molecular weight of the viscosity index improvers other than the olefin (co)polymer-based viscosity index improvers. However, the weight-average molecular weight is usually from 10,000 to 1,000,000, preferably from 100,000 to 500,000, even more preferably from 150,000 to 300,000, and particularly preferably from 150,000 to 250,000.

In the present invention, in order to improve the viscosity-temperature properties, the hydraulic oil composition particularly preferably contains a polymethacrylate-based viscosity index improver with a weight-average molecular weight of 150,000 to 250,000.

There is no particular restriction on the content of the viscosity index improvers other than the olefin (co)polymer-based viscosity index improvers. However, the content is preferably from 0.01 to 10 percent by mass, more preferably from 0.1 to 5 percent by mass, and particularly preferably from 0.5 to 3 percent by mass, in terms of polymer (amount of active constituents) based on the hydraulic oil composition for shock absorbers.

Friction modifiers may be any of compounds which are usually used as friction modifiers for lubricating oils. Examples of such friction modifiers include molybdenum-based friction modifiers such as molybdenum dithiocarbamate, molybdenum dithiophosphate, molybdenum-amine complexes, molybdenum-succinimide complexes and molybdenum disulfide; and ashless friction modifiers such as amine compounds, imide compounds, fatty acid esters, fatty acid amides, fatty acids, aliphatic alcohols and aliphatic ethers each having in their molecules at least one alkyl or alkenyl group, particularly straight-chain alkyl or straight-chain alkenyl group having 6 to 30 carbon atoms. Friction modifiers may be contained in an amount of usually 0.01 to 5 percent by mass, based on the total mass of the composition.

Anti-wear agent may be any of compounds which are usually used as anti-wear agents for lubricating oils. Examples of such anti-wear agents include phosphorus- and/or sulfur-containing anti-wear agents such as (thio)phosphoric acid esters, (thio)phosphorus acid esters and derivatives, metal salts and amine salts thereof; disulfides; olefin sulfides; sulfurized fats and oils; dithiocarbamate; and zinc dithiocarbamate. Anti-wear agents may be contained in an amount of usually 0.01 to 5 percent by mass, based on the total mass of the composition.

Ashless dispersants may be any of compounds which are usually used as ashless dispersants for lubricating oils. Examples of such ashless dispersants include succinimides, benzylamines and polyamines, each having an alkyl or alkenyl group having 40 to 400 carbon atoms, and derivatives thereof modified with any of boron compounds, phosphorus compounds, sulfur compounds or oxygen-containing organic compounds. Such ashless dispersants may be contained in an amount of usually 0.01 to 20 percent by mass, preferably 0.01 to 5 percent by mass, more preferably 1 percent by mass or less, and particularly preferably 0.5 percent by mass or less, based on the total mass of the composition.

Anti-oxidants may be any of compounds which are usually used as anti-oxidants for lubricating oils. Examples of such anti-oxidants include phenol-based anti-oxidants such as 2,6-di-tert-butyl-p-cresol, 4,4'-methylene bis(2,6-di-tert-butylphenol), octyl-3-(3,5-di-tert-butyl-4-hydroxyphenyl) propionate and 3-methyl-5-tert-butyl-4-hydroxyphenyl-substituted fatty acid esters and amine-based anti-oxidants such as phenyl-α-naphtylamine, alkylphenyl-α-naphtylamine and dialkyldiphenylamines. Such anti-oxidants may be contained in an amount of usually 0.01 to 5 percent by mass based on the total amount of the composition.

Fluidity improvers may be any of compounds which are usually used as fluidity improvers for lubricating oils. Examples of such fluidity improvers include polymethacrylate-based fluidity improvers.

Examples of metal deactivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamates, 2-(alkyldithio)benzoimidazoles and β-(o-carboxybenzylthio)propionitrile.

Examples of metallic detergents include alkali metal or alkaline earth metal sulfonates, phenates, salicylates and phosphonates.

Examples of anti-corrosion agents include benzotriazole-, tolyltriazole-, thiadiazole- and imidazole-based compounds.

Examples of rust inhibitors include petroleum sulfonates, alkylbenzene sulfonates, dinonylnaphthalene sulfonates, alkenylsuccinic acid esters and polyhydric alcohol esters.

Examples of demulsifiers include polyalkylene glycol-based non-ionic surfactants such as polyoxyethylenealkyl ethers, polyoxyethylenealkylphenyl ethers and polyoxyethylenealkylnaphthyl ethers.

Examples of antifoamers include silicone oils with a kinematic viscosity at 25° C. of from 0.5 to less than 10,000 $mm^2/s$ (excluding fluorine-modified silicone oils), alkenyl succinic acid derivatives, esters of polyhydroxy aliphatic alcohols and long-chain fatty acids, methylsalicylate and o-hydroxybenzyl alcohols, aluminum stearate, potassium oleate, N-dialkylallylamine nitroaminoalkanol, aromatic amine salts of isoamyloctylphosphate, alkylalkylenediphosphate, metal derivatives of thioethers, metal derivatives of disulfides, fluorine compounds containing aliphatic hydrocarbon groups, triethylsilane, dichlorosilane, alkylphenylpolyethylene glycol ether sulfides, and fluoroalkyl ethers.

In the case of adding these additives to the hydraulic oil composition for shock absorbers of the present invention, fluidity improvers, metallic detergents, anti-corrosion agents, rust inhibitors, and demulsifiers may be each contained in an amount of 0.005 to 5 percent by mass, metal deactivators may be contained in an amount of 0.005 to 1 percent by mass, and antifoamers may be contained in an amount of 0.0001 to 0.01 percent by mass, all based on the total mass of the composition.

The kinematic viscosity at 40° C. of the hydraulic oil composition for shock absorbers of the present invention is usually from 3 to 60 $mm^2/s$, preferably from 6 to 20 $mm^2/s$, and particularly preferably from 8 to 15 $mm^2/s$.

As described above, blend of a lubricating base oil with at least one type of the above-described silicone oils and alternatively a specific viscosity index improver can enhance the damping force and initial damping properties of a shock absorber and thus suppress the automobile from oscillating, resulting in a hydraulic oil composition for shock absorber which is capable of providing excellent ride comfort.

The present invention will be described in more detail with reference to the following examples and comparative examples but is not limited thereto.

EXAMPLES 1 TO 5 AND COMPARATIVE EXAMPLE 1

A paraffinic base oil was blended with additives each with a formulation set forth in Table 1 below such that the kinematic viscosity at 40° C. was 10 $mm^2/s$ thereby obtaining hydraulic oil compositions of the present invention (Examples 1 to 5) and a hydraulic oil composition for comparison (Comparative Example 1), respectively. Damping force was measured using each of the resulting compositions under the conditions described below. The results are also set forth in Table 1 below.

(Damping Force Test)

A shock absorber for automobiles containing each of the sample oils obtained above was oscillated at room temperature (20° C.) such that the rod speed was 0.6 m/s and the oscillating movement thereof is ±23.5 mm, so as to measure the damping force applied when the shock absorber extended. A higher damping force indicates that more oscillation can be absorbed, resulting in an improvement in the ride comfort of an automobile.

TABLE 1

| Contents of Additives (based on the total mass of the composition, mass %) | Comparative Example 1 | Example 1 | Example 2 | Example 3 | Example 4 | Example 5 |
|---|---|---|---|---|---|---|
| Silicone oil A[1)] | 0.005 | — | — | — | — | |
| Silicone oil B[2)] | — | 0.005 | — | — | 0.003 | 0.003 |
| Silicone oil C[3)] | — | — | 0.005 | — | — | |
| Silicone oil D[4)] | — | — | — | 0.002 | — | |
| Viscosity index improver[5)] | — | — | — | — | 1 | |
| Viscosity index improver[6)] | | | | | | 1 |
| Other additives[7)] | 1.6 | 1.6 | 1.6 | 1.6 | 1.6 | 1.6 |
| Damping force, kgf | 121 | 125.5 | 125.5 | 123 | 126.5 | 128.5 |

[1)]dimethylpolysiloxane 25° C. kinematic viscosity: 3,000 $mm^2/s$, actual concentration: 100%
[2)]dimethylpolysiloxane 25° C. kinematic viscosity: 50,000 $mm^2/s$, actual concentration: 100%
[3)]dimethylpolysiloxane 25° C. kinematic viscosity: 100,000 $mm^2/s$, actual concentration: 100%
[4)]dimethylpolysiloxane 25° C. kinematic viscosity: 300,000 $mm^2/s$, actual concentration: 100%
[5)]polyisobutylene-based viscosity index improver weight-average molecular weight: 500,000, actual concentration: 6 mass %
[6)]ethylene-propylene copolymer-based viscosity index improver weight-average molecular weight: 280,000, actual concentration: 10 mass %
[7)]including friction modifier, dispersant and the like As apparent from the results set forth in Table 1, the damping force was remarkably enhanced using the hydraulic oil compositions for shock absorbers according to the present invention (Examples 1 to 3), comparing with using dimethylpolysiloxane with a kinematic viscosity at 25° C. of less than 10,000 $mm^2/s$ (Comparative Example 1). It is also apparent that the damping force was further enhanced using the compositions further comprising a viscosity index improver, particularly olefin (co)polymer-based viscosity index improver (Examples 4 and 5).

EXAMPLES 6 TO 8 AND COMPARATIVE EXAMPLE 2

A lubricating base oil was blended with additives each with a formulation set forth in Table 1 below such that the kinematic viscosity at 40° C. was 10 $mm^2/s$ thereby obtaining hydraulic oil compositions of the present invention (Examples 6 to 8) and a hydraulic oil composition for comparison (Comparative Example 2). Each of the resulting composition was evaluated in terms of initial damping properties under the conditions described below. The results are also set forth in Table 2.

Initial Damping Properties

An accelerometer to measure vertical acceleration was installed in a passenger car equipped with a shock absorber containing therein each of the hydraulic oils obtained above so as to measure changes in vertical acceleration at the time the passenger car with three passengers traveled over an obstacle with a height of 3 cm at a speed of 60 km/h after a 30 minute run. The maximum value of the acceleration change (total of absolute values thereof in the extension and compression directions of the shock absorber) are set forth in Table 2 below. Smaller in acceleration change indicates that more oscillations in the vertical direction are absorbed.

At the same time of the measurement of acceleration change, the initial damping properties of the passenger car using each of the hydraulic oils were relatively evaluated. The evaluation was conducted by each of the three passengers using a grading system wherein grading "3.0" indicates the initial damping properties of the passenger car using the hydraulic oil composition of Comparative Example 2 which is the criterion of this evaluation and grading "5.0" is the highest mark thereof. The three passengers rotated in their seat positions every evaluation, and the average of the total grading points, i.e., 3 times×3 passengers are set forth in Table 2 below. Higher grading in initial damping properties indicates that oscillation are more likely to be dampen and thus the ride comfort is improved.

TABLE 2

| Contents of Additives (based on the total mass of the composition, mass %) | Comparative Example 2 | Example 6 | Example 7 | Example 8 |
|---|---|---|---|---|
| Silicone oil E[8)] | 0.002 | — | — | — |
| Silicone oil F[9)] | — | 0.0005 | 0.0005 | 0.0005 |
| Olefin polymer-based viscosity index improver[10)] | — | — | 1 | — |
| Olefin polymer-based viscosity index improver[11)] | — | — | — | 1 |
| Polymethacrylate-based viscosity index improver[12)] | 4 | 4 | — | — |
| Other additives[13)] | 1.6 | 1.6 | 1.6 | 1.6 |
| Change in acceleration in vertical direction (maximum value), $m/s^2$ | 21.6 | 15.7 | 14.7 | 12.7 |
| Initial damping properties | 3.0 | 4.3 | 4.5 | 4.7 |

[8)]dimethylpolysiloxane 25° C. kinematic viscosity: 3,000 $mm^2/s$, actual concentration: 100%
[9)]fluorine-modified silicone oil 25° C. kinematic viscosity: 300 $mm^2/s$, actual concentration: 100%
[10)]polyisobutylene-based viscosity index improver weight-average molecular weight of polymer: 300,000, actual concentration: 10 mass %
[11)]ethylene-propylene copolymer-based viscosity index improver weight-average molecular weight of polymer: 280,000, actual concentration: 10 mass %
[12)]polymethacrylate-based viscosity index improver weight-average molecular weight of polymer: 170,000, actual concentration: 63 mass %
[13)]including friction modifier, dispersant and the like As apparent from the results set forth in Table 2, the hydraulic oil compositions for shock absorbers of the present invention (Examples 6 to 8) were small in vertical acceleration change and was able to remarkably improve the initial damping properties, resulting in improved ride comfort, comparing with the fluorine-free silicone oil with a kinematic viscosity at 25° C. of less than 10,000 $mm^2/s$ (Comparative Example 2). The use of an olefin (co)polymer-based viscosity index improver was able to provide smaller vertical acceleration and more improved initial damping properties than the use of a polymethacrylate-based viscosity index improver.

From the measurement of vertical acceleration change with time, it was confirmed that the body oscillations disappeared more quickly using the compositions of Examples 6 to 8 than using the composition of Comparative Example 2.

We claim:

1. A method for improving damping force and initial damping properties of a shock absorber and for enhancing ride comfort of a vehicle equipped with the shock absorber comprising a step of using a hydraulic oil composition for the shock absorber, wherein the hydraulic oil composition comprises a lubricating base oil, at least one viscosity index improver and at least one fluorine-modified silicone oil, wherein the at least one viscosity index improver is selected from the group consisting of an olefin (co)polymer-based viscosity index improver with a weight-average molecular weight of 250,000 to 350,000 and a polymethacrylate-based viscosity index improver with a weight-average molecular weight of 150,000 to 250,000, wherein the hydraulic oil composition has a kinematic viscosity at 40° C. of 8 to 15 $mm^2/s$, and wherein the at least one fluorine-modified silicone oil is contained in the hydraulic oil composition in an amount of 1 to 100 ppm by mass based on a total mass of the hydraulic oil composition, has a kinematic viscosity at 25° C. of 50 to 2,000 $mm^2/s$, and is represented by formula (1):

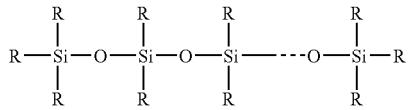

(1)

wherein groups R are each independently a hydrocarbon group and all or part of the groups R are substituted with a fluoroalkyl group having 1 to 10 carbon atoms.

2. The method according to claim 1, wherein the olefin (co)polymer-based viscosity index improver is an ethylene-propylene copolymer-based viscosity index improver.

3. The method according to claim 1, wherein the olefin (co)polymer-based viscosity index improver is a polybutene-based viscosity index improver.

4. The method according to claim 1, wherein a content of the olefin (co)polymer-based viscosity index improver is from 0.01 to less than 1 percent by mass in terms of polymer based on a total mass of the composition.

* * * * *